US007676875B2

(12) United States Patent
Cho

(10) Patent No.: US 7,676,875 B2
(45) Date of Patent: Mar. 16, 2010

(54) MULTI-DIRECTIONAL TOOTHBRUSH FOR PROTECTIVE TEETH

(75) Inventor: Yun Sang Cho, Seoul (KR)

(73) Assignee: Brian Cho, Indian Creek, IL (US)

( * ) Notice: Subject to any disclaimer, the term of this patent is extended or adjusted under 35 U.S.C. 154(b) by 224 days.

(21) Appl. No.: 11/873,262

(22) Filed: Oct. 16, 2007

(65) Prior Publication Data

US 2009/0056045 A1 Mar. 5, 2009

(30) Foreign Application Priority Data

Sep. 3, 2007 (KR) ..... 10-2007-0089215

(51) Int. Cl.

| | |
|---|---|
| ***A46B 7/00*** | (2006.01) |
| ***A46B 7/06*** | (2006.01) |
| ***A46B 7/10*** | (2006.01) |
| ***A46B 13/08*** | (2006.01) |

(52) U.S. Cl. ..... 15/27; 15/167.2; 15/23; 15/22.2; 15/22.1

(58) Field of Classification Search ..... 15/27, 15/25, 26, 167.2, 22.2, 23, 22.1; 601/141, 601/142

See application file for complete search history.

(56) References Cited

U.S. PATENT DOCUMENTS

| | | | | |
|---|---|---|---|---|
| 1,225,955 | A * | 5/1917 | Hickman | 15/167.2 |
| 2,220,053 | A * | 10/1940 | Pruner | 15/27 |
| 5,186,627 | A * | 2/1993 | Amit et al. | 433/216 |
| 6,343,396 | B1 * | 2/2002 | Simovitz et al. | 15/27 |
| 6,658,686 | B1 * | 12/2003 | Lee | 15/27 |

FOREIGN PATENT DOCUMENTS

| | | | |
|---|---|---|---|
| FR | 1300138 | * | 8/1962 |

* cited by examiner

*Primary Examiner*—Gary K Graham
(74) *Attorney, Agent, or Firm*—Vedder Price P.C.

(57) ABSTRACT

Disclosed herein is a multi-directional toothbrush for protecting teeth. The multi-directional toothbrush includes a rotatable toothbrush part, a rotatable toothbrush part support frame, and a vertically moving toothbrush part. The rotatable toothbrush part is configured such that a cylindrical toothbrush part is provided on the outer surface of a cylindrical body. The rotatable toothbrush part support frame is configured such that the cam shafts of the rotatable toothbrush part are fitted into respective cam shaft holes. The vertically moving toothbrush part includes a vertically moving frame that is contained in the internal space of the rotatable toothbrush part support frame, and reciprocates up and down using a vertical moving means.

6 Claims, 5 Drawing Sheets

MULTI-DIRECTIONAL TOOTHBRUSH FOR PROTECTIVE TEETH

BACKGROUND OF THE INVENTION

1. Field of the Invention

The present invention relates generally to a multi-directional toothbrush for protecting teeth and, more particularly, to a multi-directional toothbrush for protecting teeth, which is provided with a rotatable toothbrush part, which vertically and laterally brushes teeth so that the front and rear surfaces of teeth are brushed by vertical movement and the ends of teeth are bushed by rotation, a vertically moving toothbrush part, which operates in conjunction with the rotatable toothbrush part and thus reciprocates up and down, and has side toothbrush parts so that two surfaces of teeth can be simultaneously brushed, and a rotatable toothbrush part support frame, which guides the rotation of the rotatable toothbrush part and is coupled to a toothbrush handle.

2. Description of the Related Art

Generally, a toothbrush is configured such that toothbrush bristles are implanted into a base surface, and thus teeth can be brushed by appropriately moving the toothbrush to conform to the shapes of the teeth. However, there are problems in that brushing takes a lot of time because the front and rear surfaces and ends of teeth must be sequentially brushed, in that the gums can be damaged, and in that it is difficult to brush teeth in the vertical direction of teeth, as is recommended by dentists.

SUMMARY OF THE INVENTION

Accordingly, the present invention has been made keeping in mind the above problems occurring in the prior art, and the present invention is intended to provide a multi-directional toothbrush, which can simultaneously brush the front and rear surfaces of teeth and the ends of the teeth at one time while reciprocating vertically and laterally using a cylindrical rotatable toothbrush part, which moves laterally, and a vertically moving toothbrush part, which operates in conjunction with the rotatable toothbrush part and thus brushes both the front and rear surfaces of teeth while moving up and down.

Furthermore, the present invention is intended to provide a multi-directional toothbrush, in which debris is discharged through a discharge hole or an opening in a bottom, without being collected even when a rotatable toothbrush part support frame, in which the rotatable toothbrush part is provided, is used, thus improving sanitation.

The present invention provides a multi-directional toothbrush for protecting teeth, including: a rotatable toothbrush part configured such that a cylindrical toothbrush part is provided on the outer surface of a cylindrical body so that the ends of teeth can be brushed, and cams and cam shafts protrude from the respective ends of the cylindrical body; a rotatable toothbrush part support frame configured such that the cam shafts of the rotatable toothbrush part are fitted into respective cam shaft holes that are formed in both side surfaces of the rotatable toothbrush part support frame, and configured to be fastened to a toothbrush handle; and a vertically moving toothbrush part comprising a vertically moving frame that is contained in the internal space of the rotatable toothbrush part support frame, and reciprocates up and down using vertical moving means, which operates in conjunction with the cams that supports the cam shafts, and configured such that side toothbrush parts for brushing both the front and rear surfaces of the teeth are formed on the internal surfaces of the vertically moving frame and come into elastic contact with the teeth so as to conform to the shapes of the teeth.

BRIEF DESCRIPTION OF THE DRAWINGS

The above and other objects, features and advantages of the present invention will be more clearly understood from the following detailed description taken in conjunction with the accompanying drawings, in which.

DESCRIPTION OF THE PREFERRED EMBODIMENTS

Embodiments of the present invention are described in detail with reference to the accompanying drawings below.

Figure 1:
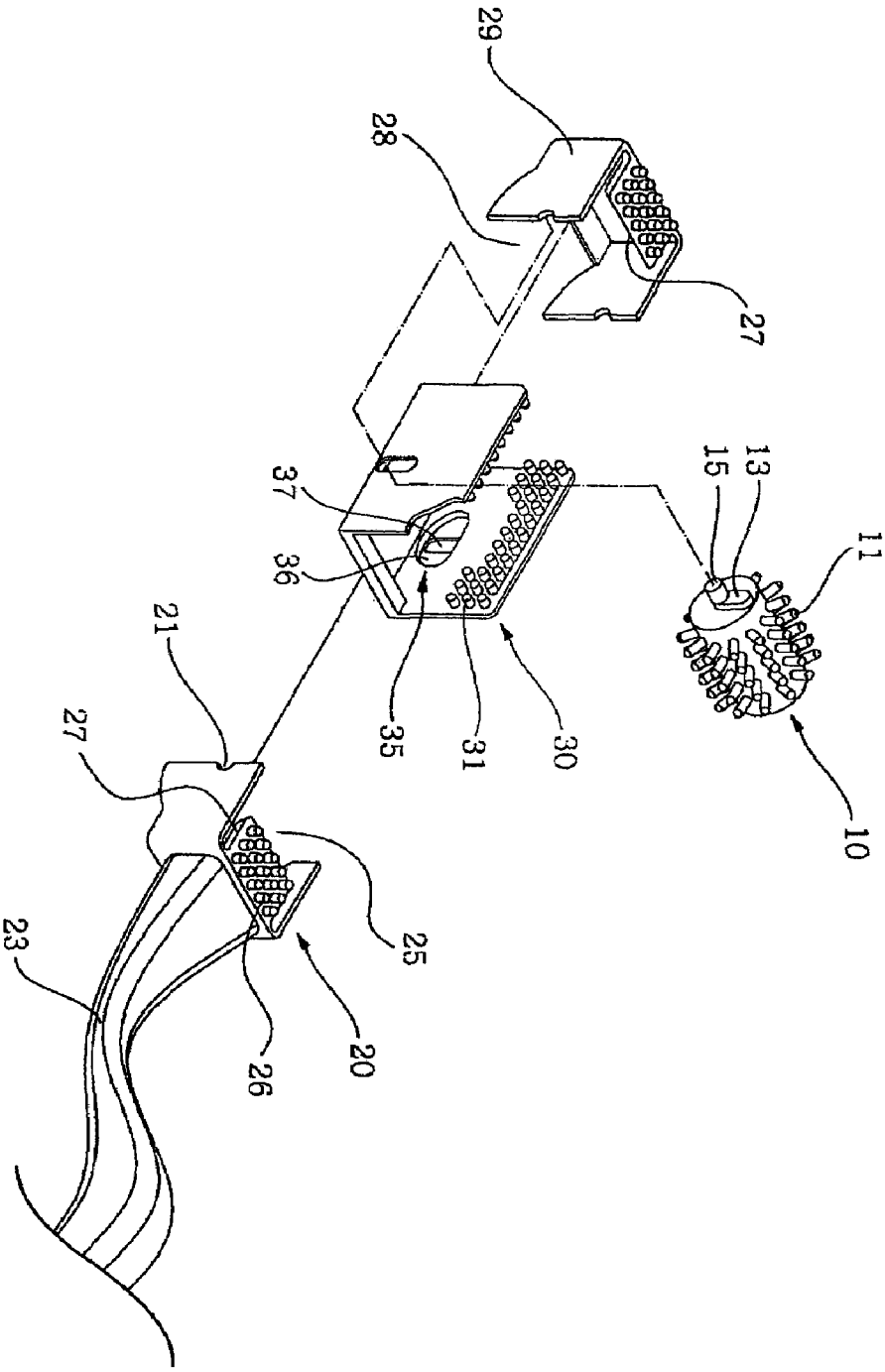
FIG. 1 is an exploded view of a first embodiment of the present invention.
Figure 2:
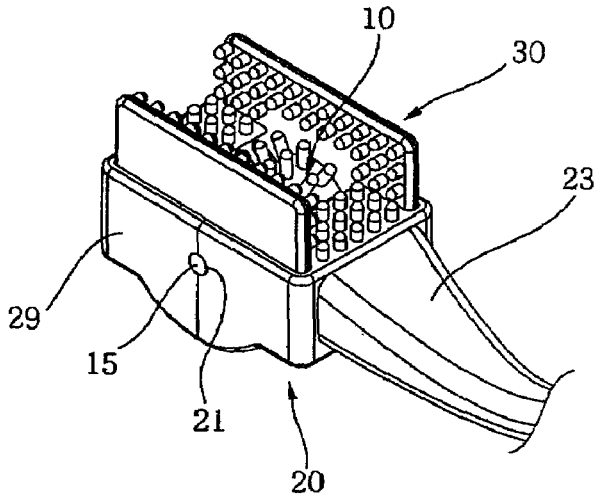
FIG. 2 is a perspective view showing the coupled state of the first embodiment of the present invention.
Figure 3:
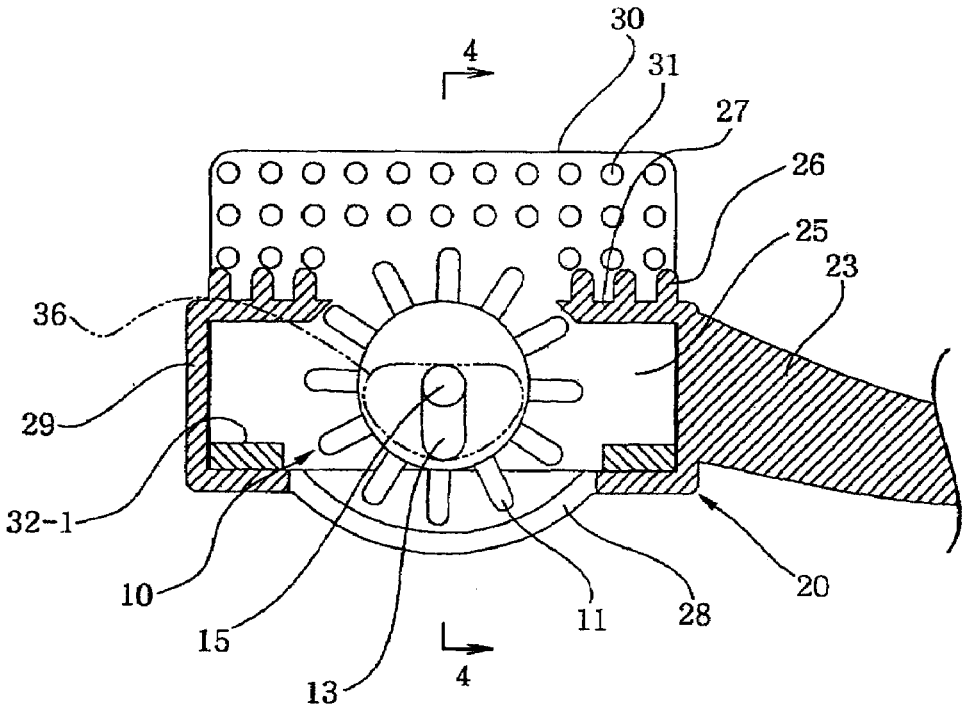
FIG. 3 is a longitudinal section showing the principal parts of the first embodiment of the present invention.
Figure 4:
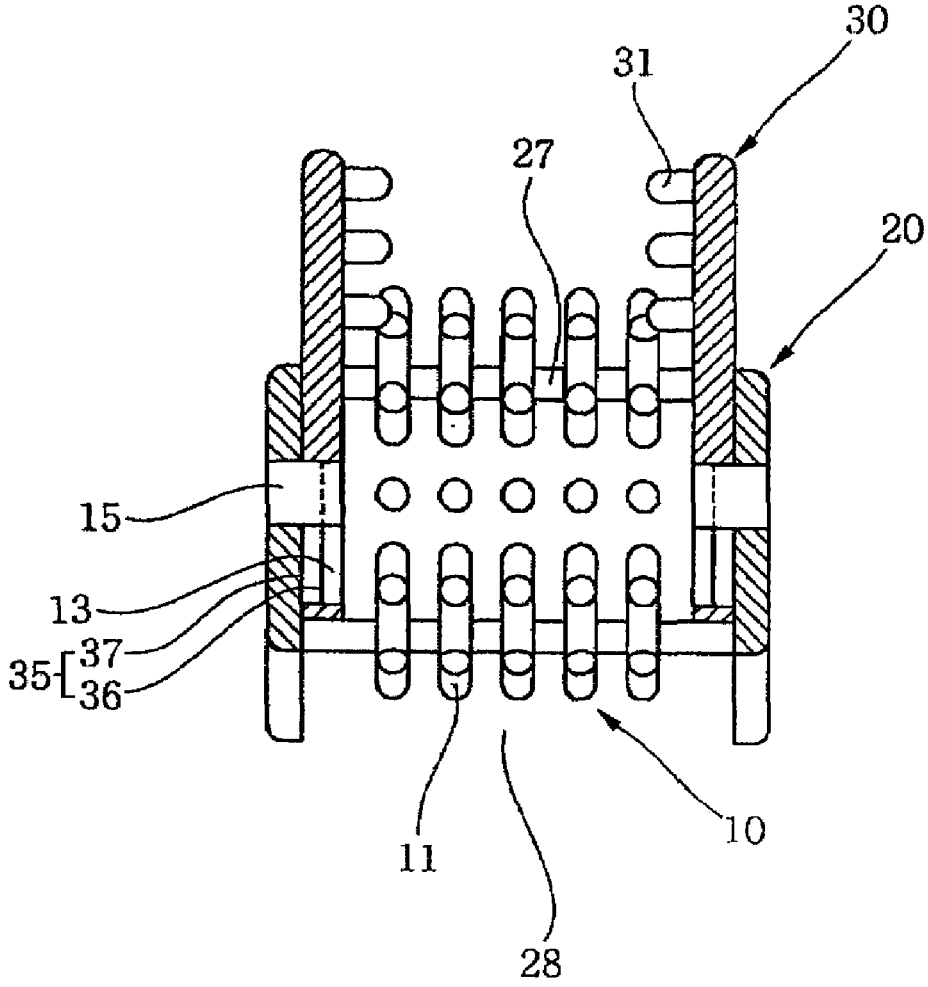
FIG. 4 is a sectional view, taken along line 4-4 of FIG. 3.
Figure 5:
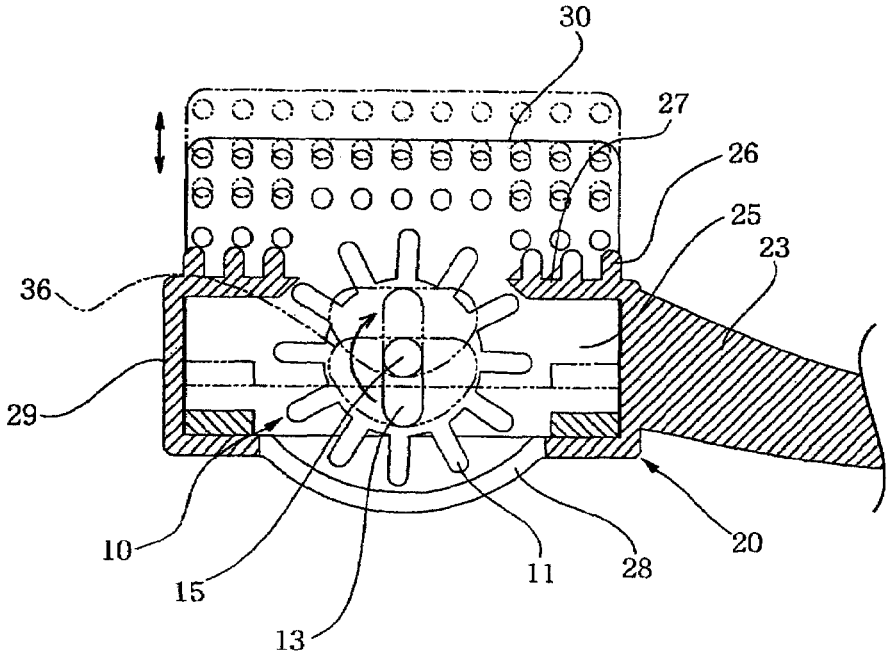
FIG. 5 is a sectional view showing the use of the parts of FIG. 3.

FIG. 1 is an exploded view of a first embodiment of the present invention, FIG. 2 is a perspective view showing the coupled state of the first embodiment of the present invention, FIG. 3 is a longitudinal section showing the principal parts of the first embodiment of the present invention, FIG. 4 is a sectional view, taken along line 4-4 of FIG. 3, and FIG. 5 is a sectional view showing the use of the parts of FIG. 3.

As shown in the drawings, the multi-directional toothbrush of the present embodiment includes a rotatable toothbrush part 10, a rotatable toothbrush part support frame 20, and a vertically moving toothbrush part 30.

The rotatable toothbrush part 10 is configured such that a cylindrical toothbrush part 11 is provided on the outer surface of a cylindrical body so that the ends of teeth can be brushed, and cams 13 and cam shafts 15 protrude from the respective ends of the cylindrical body.

The rotatable toothbrush part support frame 20 is configured such that the cam shafts 15 of the rotatable toothbrush part 10 are fitted into respective cam shaft holes 21, which are formed in both side surfaces of the rotatable toothbrush part support frame 20, and is fastened to a toothbrush handle 23.

The vertically moving toothbrush part 30 includes a vertically moving frame 32 that is contained in the internal space of the rotatable toothbrush part support frame 20, and reciprocates up and down using a vertical moving means, which operates in conjunction with the cams 13 that supports the cam shafts 13. Furthermore, the vertically moving frame 32 is configured such that side toothbrush parts 31 for brushing both the front and rear surfaces of the teeth are formed on the internal surfaces of the vertically moving frame 32 and come into elastic contact with the teeth so as to conform to shapes of the teeth.

The rotatable toothbrush part support frame 20 further includes guide protrusion plates 27, which guides the vertically moving toothbrush part 30 and on respective upper surfaces of which auxiliary toothbrush parts 26 are formed.

A discharge hole 28, through which debris is discharged, is formed in the bottom of the rotatable toothbrush part support frame 20.

The vertical moving means 35 of the vertically moving toothbrush part 30 includes cam depressions 36, which are located below respective side toothbrush parts 31 and contain the sections and portions of the cams 13, which protrude from the respective ends of the rotatable toothbrush part 10, to a predetermined depth, and longitudinal holes, which are formed to vertically extend in the respective cam depressions 36 and are coupled with the respective cam shafts 15.

The vertically moving toothbrush part 30 is configured such that the respective side toothbrush parts 31 are formed in the upper portions of the internal sides of a vertically moving frame 32, the upper and lower portions and front and rear ends of which are open. Here, the vertically moving frame 32 has elasticity so that it can come into contact with the teeth so as to conform to the shapes of the teeth. The cam depressions 36 and the longitudinal holes 37 constitute the vertical moving means 35 in the vertically moving frame 32 located below the side toothbrush parts 31.

In the lower opening part of the vertically moving frame 32, bridges 32-1 for connecting the bodies of the side toothbrush parts 31 to each other are provided in a portion other than a space through which the lower portion of the rotatable toothbrush part 10 passes 31.

It is preferred that the vertically moving frame 32 of the vertically moving toothbrush part 30 be implemented using plastic having flexibility and elastic stiffness so that it can always come into contact with teeth according to the thickness or aligned state of the teeth. Preferably, the plastic may be made of any of polyethylene, poly(vinyl acetate), polyurethane, silicon, rubber, or a combination thereof, that is, synthesized material. Furthermore, the plastic may also be made of a material, which enables the shape of the vertically moving frame 32 to be maintained and also provides elasticity that enables the brushing of teeth.

In the first embodiment of the present invention, constructed as described above, as shown in FIG. 1, the cams 13 are inserted into the respective cam depressions 36 constituting the vertical moving means 35 of the vertically moving toothbrush part 30, and the cam shafts 15 are inserted into the longitudinal holes 37. Thus, the rotatable toothbrush part 10 is coupled with the vertically moving toothbrush part 30 so as to be able to rotate.

Coupling is made such that the resulting structure is located in the internal space 25 of the rotatable toothbrush part support frame 20, which is divided into two parts on the basis of the cam shaft holes 21. In this case, the coupling is made using cap parts 29, which are in a separated state (here, the term 'coupling' is used to indicate that various coupling methods, such as fitting, hooking, bonding and high frequency welding, may be used). Accordingly, the assembled state of FIG. 2 and the longitudinal section of FIG. 3 are acquired.

In the case where the angle of the assembled multi-directional toothbrush is the same as in FIG. 2 when the multi-directional toothbrush is used, the upper teeth can be brushed. In this case, the lower ends of the upper teeth come into contact with the rotatable toothbrush part 10, and the front and rear surfaces of the upper teeth come into contact with the side toothbrush parts 31. Here, the multi-directional toothbrush is used after toothpaste is first applied, in the same manner as for a conventional toothbrush. When the toothbrush handle 23 moves laterally in the state in which the rotatable toothbrush part 10 is in contact with the ends of the teeth, as shown in FIGS. 3, 4 and 5, the rotatable toothbrush part 10 rotates as shown in FIG. 5.

Such rotation is caused by the rotation of the cams 13, and causes the cams 13 to move along the cam depressions 36. Since the longitudinal holes 37 are located in the center portions of the cam depressions 36, the vertically moving toothbrush part 30 is moved up and down, that is, in the directions of the arrows of FIG. 5, by the pushing force of the cams 13. As a result, this provides an effect in which the side toothbrush parts 31 can brush both the front and rear surfaces of the teeth while reciprocating in the vertical direction of the upper teeth. In this case, in the present embodiment, the guide protrusion plates 27 are located inside the front and rear ends of the rotatable toothbrush part support frame 20, and the guide protrusion plates 27 are provided with the respective vertical auxiliary toothbrush parts 26, and thus the ends of the teeth can be prevented from coming into direct contact with the toothbrush part 11 of the rotatable toothbrush part 10. Furthermore, the rotatable toothbrush part support frame 20 functions as a guide path through which the ends of the teeth move, and thus the ends of the teeth can be thoroughly brushed.

When the operation is repeated on front and rear surfaces, the ends of the teeth can be brushed simultaneously with the front and rear surfaces of the teeth. Furthermore, when the toothbrush moves laterally, the ends of the teeth can be brushed by the rotation, attributable to the operation of the rotatable toothbrush part 10. Furthermore, the vertically moving toothbrush part 30 enables the teeth to be naturally brushed in the vertical direction of the teeth due to its vertical movement. Such brushing is recommended by dentists.

Meanwhile, after the toothbrush is used, debris is smoothly discharged through the discharge hole 28, which is formed in the bottom of the rotatable toothbrush part support frame 20. Thus, the toothbrush can be kept in a sanitary condition.

Furthermore, the vertically moving frame 32, which supports the side toothbrush parts 31, is made of synthetic resin material having flexibility, so that, even if the teeth differ from each other in thickness or are non-uniformly aligned, teeth can be brushed in the state in which the toothbrush is always in contact with the surfaces of the teeth, with the result that constant brushing can be achieved regardless of the states of teeth.

Figure 6:
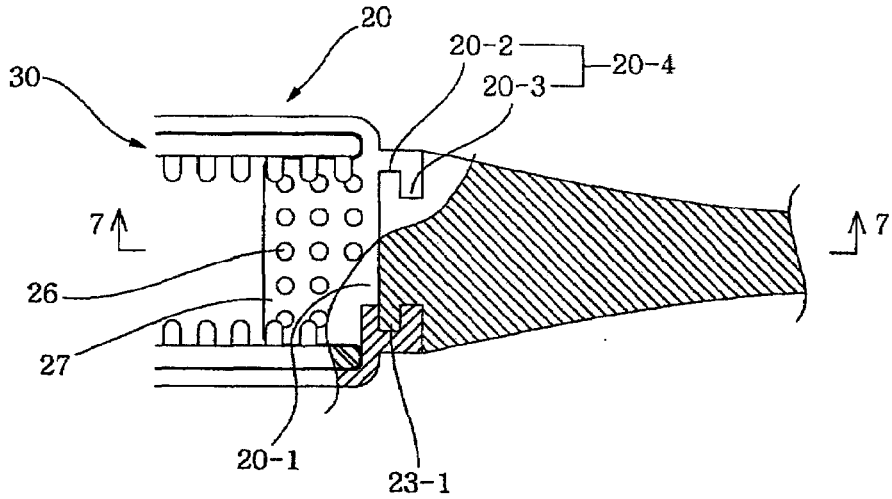
FIG. 6 is a cutaway pla view showing the principal parts of a second embodiment of the present invention.
Figure 7:
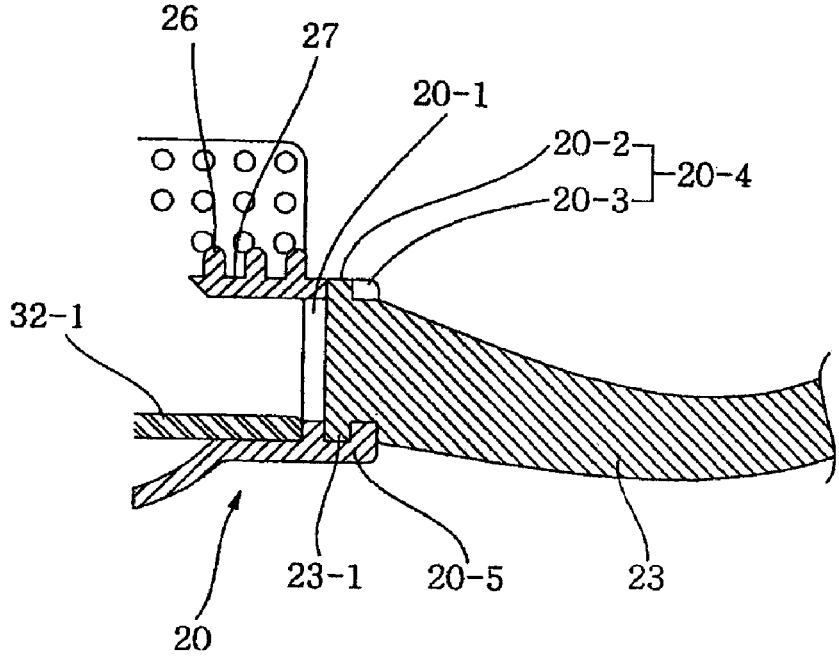
FIG. 7 is a sectional view, taken along line 7-7 of FIG. 6.

FIG. 6 is a cutaway pla view showing the principal parts of a second embodiment of the present invention, and FIG. 7 is a sectional view of FIG. 7. In the present embodiment, a rotatable toothbrush part support frame 20 and a toothbrush handle 23 are configured to be separable from each other using a separation and coupling means. An openable hole 20-1 is formed in a coupling portion between the rotatable toothbrush part support frame 20 and the toothbrush handle 23, and functions to discharge debris as an internal space 25 is be exposed outside when the rotatable toothbrush part support frame 20 and the toothbrush handle 23 are separated from each other.

The separation and coupling means includes coupling protrusions 23-1 which protrude from the respective sides of the leading end of the toothbrush handle 23, a coupling groove 20-2 which is formed in the rotatable toothbrush part support frame 20 so as to be engaged with the coupling protrusions 23-1, and coupling rails 20-3 which support the coupling protrusions 23-1 so that the coupling protrusions 23-1 can be maintained in a coupled state after the coupling protrusions 23-1 are fitted into the coupling groove 20-2.

Since the basic construction and operation of the second embodiment is the same as for the first embodiment, except for the above-described construction and operation, descriptions thereof are omitted.

Here, in the second embodiment of the present invention, the toothbrush handle 23 and the rotatable toothbrush part support frame 20 are configured to be separable from each other using a separation and coupling means. When they are separated from each other, the openable hole 20-1, which communicates with the internal space 25, which is blocked by the toothbrush handle 23, is exposed, so that cleaning can be conducted while debris is discharged through the openable hole 20-1. Furthermore, as needed, the rotatable toothbrush part 10 and the vertically moving toothbrush part 30, in addition to the rotatable toothbrush part support frame 20, may be changed and used when they are worn away.

Furthermore, the discharge hole 28, which forms the bottom of the rotatable toothbrush part support frame 20, can be blocked, and thus damage to the gums or the surface of the tongue, attributable to the exposed discharge hole 28, can be prevented from occurring.

As described above, the multi-directional brush according to the present invention can simultaneously brush the front and rear surfaces of teeth and the ends of the teeth at one time while moving vertically and laterally using the cylindrical type rotatable toothbrush part, which moves laterally, and the vertically moving toothbrush part, which brushes both the front and rear surfaces of teeth while reciprocating up and down by operating in conjunction with the rotatable toothbrush part.

Furthermore, the multi-directional brush according to the present invention can discharge debris through the discharge hole in the bottom, or the openable hole, which is exposed outside when the toothbrush handle is separated from the rotatable toothbrush part support frame, without being collected when the rotatable toothbrush part support frame, in which the rotatable toothbrush part is provided, is used, so that it can improve sanitation.

Furthermore, in the present invention, the vertically moving frame, which supports the side toothbrush parts, is made of flexible material, and thus constant brushing can be achieved because uniform close contact is realized even if teeth differ from each other in thickness or size.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A multi-directional toothbrush for protecting teeth, comprising:

a rotatable toothbrush part configured such that a cylindrical toothbrush part is provided on an outer surface of a cylindrical body so that the ends of teeth can be brushed, and cams and cam shafts protrude from respective ends of the cylindrical body;

a rotatable toothbrush part support frame configured such that the cam shafts of the rotatable toothbrush part are fitted into respective cam shaft holes that are formed in both side surfaces of the rotatable toothbrush part support frame, and fastened to a toothbrush handle; and a vertically movable toothbrush part comprising a vertically movable frame that is contained in an internal space of the rotatable toothbrush part support frame, and reciprocates up and down using vertical moving means, which operates in conjunction with the cams that supports the cam shafts, and is configured such that side toothbrush parts for brushing both the front and rear surfaces of the teeth are formed on internal surfaces of the vertically movable frame and come into elastic contact with the teeth so as to conform to shapes of the teeth.

2. The multi-directional toothbrush as set forth in claim 1, wherein the rotatable toothbrush part support frame further comprises:

guide protrusion plates, which guide the movement of the vertically movable toothbrush part, and on respective upper surfaces of which auxiliary toothbrush parts are formed, the guide protrusion plates being provided in respective central portions of front and rear parts of the rotatable toothbrush part support frame.

3. The multi-directional toothbrush as set forth in claim 1, wherein a discharge hole, through which debris is discharged, is formed in a bottom of the rotatable toothbrush part support frame.

4. The multi-directional toothbrush as set forth in claim 1, wherein the vertical moving means of the vertically movable toothbrush part comprises:

cam depressions which are located below the respective side toothbrush parts and contain the sections and portions of the cams, which protrude from the respective ends of the rotatable toothbrush part, to a predetermined depth; and longitudinal holes, which are formed to vertically extend in the respective cam depressions and are coupled with the respective cam shafts.

5. The multi-directional toothbrush as set forth in claim 1, wherein:

the rotatable toothbrush part support frame and the toothbrush handle are configured to be separable from each other using a separation and coupling means, and an openable hole, which is formed in a coupling portion between the rotatable toothbrush part support frame and the toothbrush handle and functions to discharge debris as an internal space is exposed outside when the rotatable toothbrush part support frame and the toothbrush handle are separated from each other, is provided.

6. The multi-directional toothbrush as set forth in claim 5, wherein the separation and coupling means includes coupling protrusions which protrude from respective sides of leading end of the toothbrush handle, a coupling groove, which is formed in the rotatable toothbrush part support frame so as to be engaged with the coupling protrusions, and coupling rails which support the coupling protrusions so that the coupling protrusions can be maintained in a coupled state after the coupling protrusions are fitted into the coupling groove.

* * * * *